US009164437B2

(12) United States Patent
Fuse

(10) Patent No.: US 9,164,437 B2
(45) Date of Patent: Oct. 20, 2015

(54) IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Hiroyuki Fuse, Nagaizumi Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/478,881

(22) Filed: Sep. 5, 2014

(65) Prior Publication Data

US 2015/0117925 A1 Apr. 30, 2015

(30) Foreign Application Priority Data

Oct. 24, 2013 (JP) ..... 2013-221535

(51) Int. Cl.
*G03G 15/20* (2006.01)
*G03G 21/20* (2006.01)

(52) U.S. Cl.
CPC ..... *G03G 15/2039* (2013.01); *G03G 15/2028* (2013.01); *G03G 21/203* (2013.01); *G03G 2215/00531* (2013.01); *G03G 2215/00776* (2013.01); *G03G 2215/0132* (2013.01)

(58) Field of Classification Search
CPC ..... G03G 15/2039
See application file for complete search history.

(56) References Cited

U.S. PATENT DOCUMENTS

2007/0235924 A1* 10/2007 Kimura ..... 271/265.01
2010/0002037 A1* 1/2010 Kusuhata ..... 347/16
2010/0111546 A1* 5/2010 Kubo ..... 399/16

FOREIGN PATENT DOCUMENTS

JP 07175400 A * 7/1995 ..... G03G 21/20
JP 2013174802 A 9/2013

* cited by examiner

*Primary Examiner* — Blake A Tankersley
*Assistant Examiner* — Ruben Parco, Jr.
(74) *Attorney, Agent, or Firm* — Patterson & Sheridan, LLP

(57) ABSTRACT

According to an embodiment, an image forming apparatus has an image forming unit, a transfer unit, a fixing unit, a first conveying path, a second conveying path, and a control unit. The image forming unit forms a toner image. The control unit controls execution of a print-less sheet passing processing in which, in a state where a toner image forming operation of the image forming unit is stopped, the first conveying path and the second conveying path convey a sheet to the transfer unit again through the transfer unit and the fixing unit. The control unit controls the execution of the toner image forming operation to the sheet subjected to the print-less sheet passing processing.

10 Claims, 3 Drawing Sheets

IMAGE FORMING APPARATUS

CROSS-REFERENCE TO RELATED APPLICATION

This application is based upon and claims the benefit of priority from the prior Japanese Patent Application No. 2013-221535, filed on Oct. 24, 2013, the entire contents of which are incorporated herein by reference.

FIELD

Embodiments described herein relate generally to an image forming apparatus having a function to reduce a failure of print image quality due to moisture absorption of a sheet.

BACKGROUND

Conventionally, image forming apparatuses adopting an electrophotographic system and so on have been put into practical use. It is known that when performing printing in a state where the humidity inside the apparatus is high, the image forming apparatus might cause a failure of print image quality.

Specifically, the image forming apparatus adopting an electrophotographic system, and so on may sometimes perform printing in a state where a ratio (hereinafter, called a moisture absorption ratio) in which a printing sheet (hereinafter, simply called a sheet), that is an image recording medium, absorbs moisture is high. When performing printing in the state where the moisture absorption ratio is high, the image forming apparatus, at the time of transferring a toner image carried on an image carrier of the image forming apparatus to a sheet, generates a transfer failure and so on of the toner image to the sheet, and thereby might cause a failure of print image quality.

In contrast, the conventional image forming apparatus has a heater (a damp heater) for preventing dew condensation, so that receiving the influence of the air temperature and humidity around the image forming apparatus, a sheet does not generate dew condensation or absorb moisture. The damp heater is a heater of about 5-10 W which is arranged for each sheet feeding cassette for housing a sheet, for example. Even when the main power source is in an OFF state, the image forming apparatus energizes the damp heater at any time.

However, in order to perform the above-described moisture absorption measure to a sheet, the image forming apparatus continues to consume electric power for the damp heater, even when the main power source is OFF.

DETAILED DESCRIPTION

Figure 1:
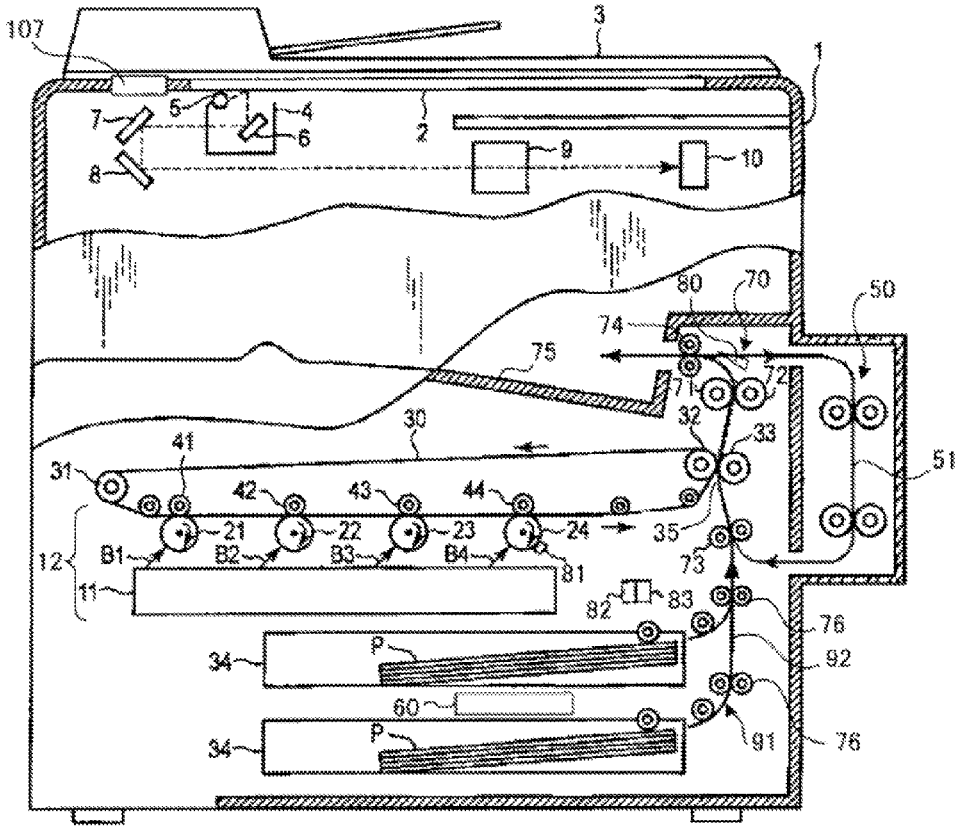
FIG. 1 is a sectional view showing a main portion of an image forming apparatus according to a first embodiment.

According to an embodiment, an image forming apparatus has an image forming unit, a transfer unit, a fixing unit, a first conveying path, a second conveying path, and a control unit. The image forming unit forms a toner image. The transfer unit transfers the toner image to a sheet. The fixing unit heats the sheet, to fix the toner image to the sheet. The first conveying path conveys the sheet to the fixing unit through the transfer unit. The second conveying path conveys the sheet which has passed through the fixing unit to a position of the first conveying path which is more upstream than the transfer unit. The control unit controls a print-less sheet passing processing in which, in a state where a toner image forming operation of the image forming unit is stopped, the first conveying path and the second conveying path convey the sheet to the fixing unit through the transfer unit. Judging that the first conveying path and the second conveying path have performed the print-less sheet passing processing by a prescribed number of times, the control unit releases the image forming operation stop state, and controls so that the image forming unit performs the toner image forming operation, to the sheet to which the print-less sheet passing processing has been finished.

Hereinafter, further embodiments will be described with reference to the drawings. In the drawings, the same symbols show the same or similar portions.

A first embodiment will be described with reference to FIG. 1. FIG. 1 is a sectional view showing a main portion of an image forming apparatus according to a first embodiment.

An image forming apparatus 1 shown in FIG. 1 is an MFP (Multi Functional Peripheral). As shown in FIG. 1, the image forming apparatus 1 has a document table glass 2, an opening/closing cover 3, and an ADF (Auto Document Feeder). The document table glass 2 is provided on the upper portion of the main body of the image forming apparatus 1. The document table glass 2 supports a document loaded by a user. The opening/closing cover 3 is openably provided above an upper surface of the document table glass 2. The opening/closing cover 3 covers the document table glass 2 in a closed state. When a document is loaded on the document table glass 2, the opening/closing cover 3 presses the document to the document table glass 2 in a closed state. The ADF is provided in the opening/closing cover 3. The ADF conveys a document to a document reading position (not shown) of a scanner device described later. The image forming apparatus 1 has the scanner device provided at the lower portion of the document table glass 2. The scanner device reads images of a document loaded on the document table glass 2, and a document conveyed to the document reading position by the ADF. The scanner device has a first scanning optical system, a second scanning optical system, an image forming lens 9, and an image reading element 10. The first scanning optical system has a moving member 4, a document illuminating lamp 5, and a first reflection mirror 6. The moving member 4 is arranged movably at a speed V in a sub scanning direction (a horizontal direction in FIG. 1) orthogonal to a main scanning direction for reading an image of a document. The document illuminating lamp 5 and the first reflection mirror 6 are provided fixedly on the moving member 4, and move in the sub scanning direction along with the moving member 4. The document illuminating lamp 5 irradiates a document loaded on the document table glass 2, and a document conveyed to the document reading position by the ADF with light. The first reflection mirror 6 leads image light reflected from the document to the second scanning optical system. The second scanning optical system has a second reflection mirror 7 and a third reflection mirror 8. While integrally holding the second reflection mirror 7 and the third reflection mirror 8, the second scanning optical system is arranged movably at a speed V/2 in the sub scanning direction. The second reflection mirror 7 and the third reflection mirror 8 lead the image light to the image forming lens 9. The image forming lens 9 forms an image of the image light on the image reading element 10. The image reading element 10 is a CCD (Charge Coupled Device), or the like, for example. Upon receiving the image light, the image reading element 10 outputs image data. For example, when the scanner device reads an image of a document loaded on the document table glass 2, the first scanning optical system and the second scanning optical system scan the document while moving in the same direction at a prescribed speed, and thereby the scanner device forms an image of the image light of the document on the image reading element 10 through the image forming lens 9.

The image forming apparatus 1 has an image forming device 12 shown in FIG. 1. The image forming device 12 can form a color image. The image forming device 12 has a laser image exposure unit 11, a plurality of image forming units, and a transfer unit. The image forming units have a photoconductor drum 21 for yellow color, a photoconductor drum 22 for magenta color, a photoconductor drum 23 for cyan color, and a photoconductor drum 24 for black color, respectively. The transfer unit has a transfer belt 30, pulleys such as a drive pulley 32 and a driven pulley 31, primary transfer rollers 41, 42, 43, 44, and a secondary transfer roller 33. The transfer belt 30 is an endless belt which is wound around the pulleys such as the drive pulley 32 and the driven pulley 31. The transfer belt 30 rotates endlessly in the direction of an arrow of FIG. 1, while making contact with the respective photoconductor drums 21-24. Each of the positions where the transfer belt 30 makes contact with the photoconductor drums 21-24 is called a primary transfer position. The drive pulley 32 supports the transfer belt 30, and is driven by a motor (not shown), to cause the transfer belt 30 to be endlessly rotated. The driven pulley 31 along with the drive pulley 32, rotate while supporting the transfer belt 30. The primary transfer rollers 41-44 are arranged inside the transfer belt 30, so as to make contact with the transfer belt 30 from the side opposite to the photoconductor drums 21-24 at the respective primary transfer positions. The secondary transfer roller 33 faces the drive roller 32 with the transfer belt 30 interposed therebetween. The position where the secondary transfer roller 33 and the drive roller face to each other is called a secondary transfer position 35. Each of the image forming units has a developing device, a cleaning device, a charger and so on (not shown) arranged around the respective one of the photoconductor drums 21-24.

The laser image exposure unit 11 irradiates the photoconductor drums 21-24 which have previously been charged uniformly by the above-described chargers with respective lasers B1, B2, B3, B4 for forming images of the respective colors, to expose the respective photoconductor drums 21-24. The laser image exposure unit 11 exposes the photoconductor drums 21-24, to form electrostatic latent images on the photoconductor drums 21-24, respectively. The developing devices of the respective colors supply toners of the respective colors to the electrostatic latent images on the photoconductor drums 21-24, to develop the electrostatic latent images, respectively. The above-described developing devices develop the electrostatic latent images, to form toner images on the photoconductor drums 21-24, respectively. The primary transfer rollers 41-44 sequentially transfer the toner images of the respective colors from the photoconductor drums 21-24 to the transfer belt 30 which is endlessly rotating at the primary transfer positions, respectively. Accordingly, the toner images are transferred in piles to the transfer belt 30 in the order of cyan, magenta, yellow, black. The secondary roller 33 and the transfer belt 30 form a nip portion therebetween at the secondary transfer position 35. The secondary roller 33 conveys a sheet P while nipping the sheet P in the nip portion to the transfer belt 30 at the secondary transfer position 35. The secondary transfer roller 33 transfers the toner images which have been primarily transferred in piles to the transfer belt 30 to the sheet P. The image forming apparatus 1 has a fixing unit 70. The fixing unit 70 has a heating roller 71 and a pressure roller 72. The heating roller 71 and the pressure roller 72 make contact with each other, to form a nip portion therebetween. The fixing unit 70 makes the sheet P pass through the nip portion between the heating roller 71 and the pressure roller 72, to heat and pressurize the non-fixed toner image of the sheet P. The fixing unit 70 heats and pressurizes the non-fixed toner image, to fix the toner image to the sheet P.

The image forming apparatus 1 has a plurality of sheet feeding cassettes 34. The plurality of sheet feeding cassettes 34 are arranged in the vertical direction in a line, in the lower portion of the main body of the image forming apparatus 1. The sheet feeding cassette 34 houses sheets P in a stacked state. The image forming apparatus 1 has a main conveying unit 91 and a sheet discharge tray 75. The main conveying unit 91 has a main conveying path 92 that is a first conveying path, a resist roller 73, a sheet discharge roller 74, and a plurality of conveying rollers 76. The main conveying path 92 conveys the sheet P taken out from the above-described sheet feeding cassette 34 through the resist roller 73, the secondary transfer position 35 and the fixing unit 70. The resist roller 73 is arranged at a position which is more upstream side than the secondary transfer position 35 in the conveying direction of the sheet P and is along the main conveying path 92. The resist roller 73 sends the sheet P to the secondary transfer position 35 in accordance with the timing of forming the above-described toner image. The main conveying path 92 sends the sheet P to which the toner image has been transferred to the fixing unit 70 in corporation with the transfer belt 30 and the secondary transfer roller 33. The sheet discharge roller 74 is arranged in the vicinity of a discharge port leading to the sheet discharge tray 75. The sheet discharge roller 74 discharges the sheet P to which the toner image has been fixed to the sheet discharge tray 75, in corporation with the heating roller 71 and the pressure roller 72 of the fixing unit 70. The sheet discharge tray 75 is arranged outside the image forming apparatus 1. The sheet discharge tray 75 holds the sheets P which have been discharged by the sheet discharge roller 74 in a stacked state. The plurality of conveying rollers 76 are arranged at positions which are more upstream than the resist roller 73 in the conveying direction of the sheet P, and are along the main conveying path 92, with an appropriate interval. The plurality of conveying rollers 76 send the sheet P taken out from the sheet feeding cassette 34 to the resist roller 73. The main conveying unit 91 further includes a motor and so on to drive the conveying rollers 76, the resist roller 73 and the sheet discharge roller 74. The image forming apparatus 1 discharges the sheet P to the sheet discharge tray 75, to finish printing of an image to the sheet P.

The image forming apparatus 1 has a reverse conveying unit 50 for printing images on both faces of a sheet P. The reverse conveying unit 50 has a reverse conveying path 51, that is a second conveying path. The reverse conveying path 51 branches from the main conveying path 92 at a branch position between the fixing unit 70 and the sheet discharge roller 74 of the main conveying path 92. The reverse conveying path 51 further merges with the main conveying path 92 at a merging position which is more upstream than the resist roller 73 in the conveying direction of the sheet P. The sheet P which has passed through the fixing unit 70 is sent from the above-described branch position to the reverse conveying path 51 by a switchback operation described later.

Specifically, the image forming apparatus 1 has a flapper 80 arranged at the above-described branch position. The flapper 80 rotates between a position to close an inlet of the reverse conveying path 51 and a position to open the inlet. When the flapper 80 is at the above-described closing position, the sheet discharge roller 74 discharges the sheet P which has been conveyed by the main conveying path 92 to the sheet discharge tray 75. The main conveying unit 91 once stops rotation of the sheet discharge roller 74 during the sheet discharge operation, after a back end of the sheet P passes through the above-described branch position and before the sheet P reaches the sheet discharge roller 74. When the rotation of the sheet discharge roller 74 stops, the image forming apparatus 1 rotates the flapper 80, to switch the position of the flapper 80 from the above-described closing position to the above-described opening position. When the position of the flapper 80 is switched to the above-described opening position, the flapper 80 opens the inlet of the reverse conveying path 51, and closes the main conveying path 92. The main conveying unit 91 reversely rotates the sheet discharge roller 74, in the state where the position of the flapper 80 has been switched to the above-described opening position. The sheet discharge roller 74 inverts the leading end and the back end of the sheet P, and sends the inverted sheet P to the reverse conveying path 51. An operation in which the sheet discharge roller 74 is reversely rotated, to send a sheet P to the reverse conveying path, in this manner, is called a switchback operation. The reverse conveying path conveys the sheet P to the above-described merging position, and then sends the sheet P to the main conveying path 92. The main conveying path 92 conveys the sheet P again which has been sent from the reverse conveying path 51 to the fixing unit 70, through the resist roller 73 and the secondary transfer position 35. For example, the image forming apparatus 1 rotates the flapper 80 before the sheet P reaches the fixing unit 70, to switch the position of the flapper 80 from the above-described opening position to the above-described closing position. Accordingly, the sheet which has passed through the fixing unit 70 reaches the sheet discharge roller 74. The sheet discharge roller 74 discharges the sheet P to the sheet discharge tray 75.

The image forming unit 1 can convey a sheet P by the main conveying path 92 of the main conveying unit 91 and the reverse conveying path 51 of the reverse conveying unit 50, in a state where an operation of forming a toner image to the transfer belt 30 is stopped. In the following description, a state where an operation of forming a toner image to the transfer belt 30 is stopped is called an image forming operation stop state. Furthermore, conveying of the above-described sheet P in the image forming operation stop state is called a print-less sheet passing processing. The image forming operation stop state may include a state where the laser exposure unit 11 stops its operation, and an electrostatic latent image is not formed on each of the photoconductor drums 21-24. Furthermore, the image forming operation stop state may include a state where the developing device of the image forming unit stops its operation, and a toner image is not formed on each of the photoconductor drums 21-24. Furthermore, the image forming operation stop state may include a state where the primary transfer rollers 41-44 of the transfer unit stop their operations, and toner images are not transferred from the respective photoconductor drums 21-24 to the transfer belt 30.

When the image forming apparatus 1 performs the above-described print-less sheet passing processing, the main conveying path 92 makes a sheet P taken out from the sheet feeding cassette 34 pass through the fixing unit 70 through the resist roller 73 and the secondary transfer position 35. During the print-less sheet passing processing, since a toner image is not formed on the transfer belt 30, when the sheet P passes through the secondary transfer position, the toner image is not transferred to the sheet P. Accordingly, the fixing unit 70 heats the sheet P to which the toner image has not been transferred. The fixing unit 70 heats the sheet P, to evaporate moisture absorbed in the sheet P. The fixing unit 70 evaporates the moisture, to make the sheet P in a low humidity state where there is no difficulty at the time of transferring a toner image. Hereinafter, a processing to heat a sheet P to make the sheet P in a low humidity state is called a moisture reducing processing sometimes. When accepting an instruction of the print-less sheet passing processing by a user, the image forming apparatus makes a sheet P in the above-described low humidity state by heating the sheet P by the fixing unit 70, and then the image forming apparatus 1 releases the image forming operation stop state. The image forming apparatus 1 finishes the print-less sheet passing processing, and performs to form a toner image on the sheet P which has been subjected to the moisture reducing processing. Specifically, in order to perform to form a toner image on the sheet P in a low humidity state, the sheet discharge roller 74 sends the sheet P subjected to the moisture reducing processing to the reverse conveying path 51 with the above-described switchback operation. In addition, in order to form the toner image on the transfer belt 30, the laser exposure unit 11, the image forming units including the respective photoconductor drums 21-24, and the primary transfer rollers 41-33 of the transfer unit start their operations. The reverse conveying path 51 sends the sheet P from the above-described merging position to the main conveying path 92. The resist roller 73 of the main conveying path 92 sends the sheet P to the secondary transfer position 35, in accordance with the timing of forming the above-described toner image, so that the toner image is transferred to the sheet P at the above-described secondary transfer position 35. In other words, the resist roller 73 is driven in accordance with the timing of forming the above-described toner image, so that the toner image is transferred to the sheet P. The secondary transfer roller 33 transfers the toner image from the transfer belt 30 to the sheet P at the secondary transfer position 35. After the toner image has been transferred, the fixing unit 70 fixes the toner image to the sheet P. After the toner image has been fixed, the sheet discharge roller 74 discharges the sheet P to the sheet discharge tray 75. Upon receiving an instruction of the print-less sheet passing processing by a user, the image forming apparatus 1 prints the toner image on the sheet P subjected to the moisture reducing processing as described above.

In the above description, after having performed the print-less sheet passing processing once using the reverse conveying path 92, the image forming apparatus 1 performed the toner image formation, but the image forming apparatus may perform the toner image formation after having performed the print-less sheet passing processing by a plurality of times. The image forming apparatus 1 performs the print-less sheet passing processings of a plurality of times, in consideration of a moisture absorption ratio of a sheet P, or a kind of a sheet P (whether or not a sheet P is a cardboard, and so on), and thereby may perform the moisture reducing processing by passing the sheet P through the fixing unit 70 by a plurality of times. To consider the kind of a sheet P is to consider the characteristic of the absorbable moisture absorption amount which the sheet P has, such as when a sheet P is a cardboard the moisture absorption amount becomes large, and when a sheet P is a thin paper the moisture absorption amount becomes small.

The image forming apparatus 1 further has a damp heater 60. The damp heater 60 is arranged on the sheet feeding cassette 34. The damp heater 60 humidifies a sheet P housed in the sheet feeding cassette 34, to perform a moisture reducing processing to the sheet P. The damp heater 60 is OFF when the main power source is OFF, and is turned ON by the condition described later.

The image forming apparatus 1 further has an image forming unit temperature sensor 81, a temperature inside apparatus sensor 82, and a humidity inside apparatus sensor 83. The image forming unit temperature sensor 81 detects a temperature of the image forming device 12. For example, the image forming unit temperature sensor 81 is arranged adjacent to the photoconductor drum 24, and detects the temperature of the image forming device 12. The image forming unit temperature sensor 81 includes a thermistor, for example. The temperature inside apparatus sensor 82 is arranged at a prescribed position inside the image forming apparatus 1, and detects an atmosphere temperature, that is a temperature of the air inside the image forming apparatus 1. The humidity inside apparatus sensor 83 is arranged at a prescribed position inside the image forming apparatus 1, and detects an atmosphere humidity, that is a humidity of the air inside the image forming apparatus 1. The prescribed position inside the image forming apparatus 1 is a position in the vicinity of the sheet feeding cassette 34 and the laser exposure unit 11, as shown in FIG. 1, for example. A control unit 100 for the moisture reducing processing shown in FIG. 2 acquires information detected by the sensors 81-83.

The control unit 100 described later determines that a sheet P is in a moisture absorbing state, when the temperature (temperature of the image forming device 12) detected by the image forming unit temperature sensor 81 is lower than the temperature (atmosphere temperature inside the image forming apparatus 1) detected by the temperature inside apparatus sensor 82, and the humidity (atmosphere humidity inside the image forming apparatus 1) detected by the humidity inside apparatus sensor 83 is higher than a prescribed humidity. Hereinafter, the state in which a sheet P is in a moisture absorbing state is called a sheet moisture absorption state. On the other hand, the control unit 100 determines that a sheet P is not in the sheet moisture absorption state, when the temperature (temperature of the image forming device 12) detected by the image forming unit temperature sensor 81 is higher than the temperature (atmosphere temperature inside the image forming apparatus 1) detected by the temperature inside apparatus sensor 82, and the humidity (atmosphere humidity inside the image forming apparatus 1) detected by the humidity inside apparatus sensor 83 is lower than a prescribed humidity.

Furthermore, the sheet feeding cassette 34 stores sheet information. The sheet information includes information as to whether or not a sheet which the sheet feeding cassette 34 houses is a cardboard, in other words, information regarding a class of a sheet as to whether or not the sheet has characteristic where moisture absorption amount of the sheet becomes large. The control unit 100 acquires the sheet information stored in the sheet feeding cassette 34. The control unit 100 may acquire the sheet information, based on input information which an operation unit 107 of the image forming apparatus 1 has accepted.

Figure 2:
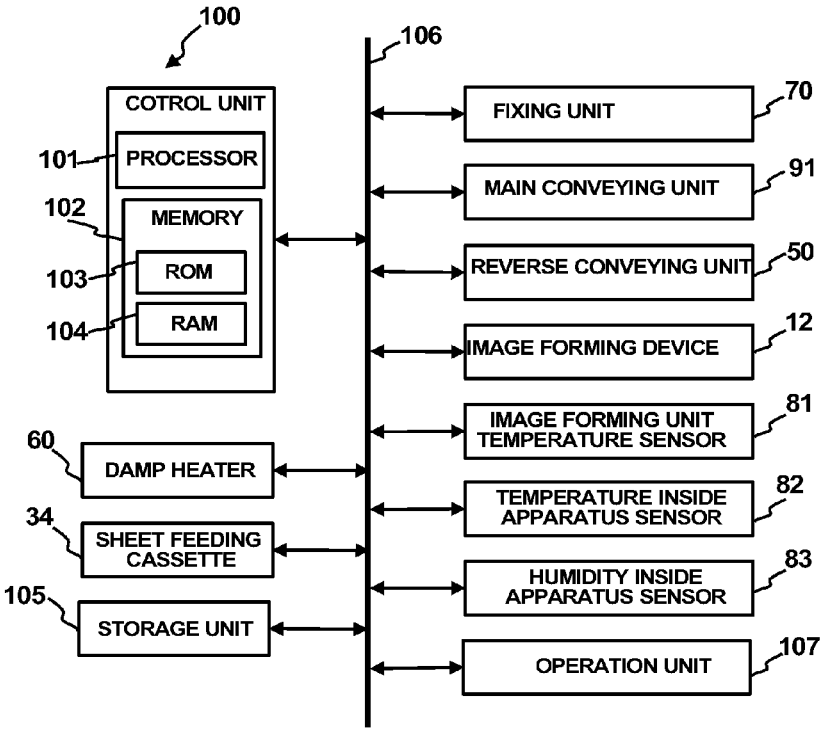
FIG. 2 is a block diagram showing a control configuration of a moisture reducing processing of a sheet of the image forming apparatus according to the first embodiment.

Hereinafter, a control configuration for moisture reducing processing will be described with reference to FIG. 2. FIG. 2 is a block diagram showing a control configuration of a moisture reducing processing of a sheet P of the image forming apparatus 1. As shown in FIG. 2, as a control configuration for moisture reducing processing, the image forming apparatus 1 has the control unit 100, the damp heater 60, the sheet feeding cassette 34, the fixing unit 70, the main conveying unit 91, the reverse conveying unit 50, the image forming device 12, the image forming unit temperature sensor 81, the temperature inside apparatus sensor 82, the humidity inside apparatus sensor 83, a storage unit 105, an operation unit 107, and so on. The above-described constituent elements for the moisture reducing processing are connected through a bus 106.

The control unit 100 controls the whole of the image forming apparatus 1. The control unit 100 has a processor 101 and a memory 102. The processor 101 includes a CPU (Central Processing Unit) or an MPU (Micro Processing Unit).

The memory 102 is a semiconductor memory, for example. The memory 102 has a ROM (Read Only Memory) 103 and a RAM (Random Access Memory) 104. The ROM 103 stores various control programs. The RAM 104 provides a temporary working area to the processor 101. The ROM 103 further stores a program to judge whether or not the inside of the image forming apparatus 1 is in a sheet moisture absorption state. The ROM 103 further stores a program of a first dehumidification mode and a program of a second dehumidification mode, and so on.

The first dehumidification mode and the second dehumidification mode are control modes for moisture reducing processing by the control unit 100. The first dehumidification mode and the second dehumidification mode are selected, when the operation unit 107 of the image forming apparatus 1 accepts a user's operation. In other words, a user can select the first dehumidification mode and the second dehumidification mode, by operating the operation unit 107. As described above, the control unit 100 determine whether or not a sheet P inside the sheet feeding cassette 34 is in the sheet moisture absorption state, based on the temperature detected by the image forming unit temperature sensor 81, the temperature detected by the temperature inside apparatus sensor 82, and the humidity detected by the humidity inside apparatus sensor 83. For example, when the detection temperature of the image forming unit temperature sensor 81 is lower than the detection temperature of the temperature inside apparatus sensor 82, and the detection humidity of the humidity inside apparatus sensor 83 is not less than a prescribed humidity, the control unit 100 determines that the sheet P in the sheet feeding cassette 34 is in the sheet moisture absorption state. A method of determining a sheet moisture absorption state of a sheet P is not limited to a determination method based on the detection information of the above-described sensors 81-83. For example, when the moisture absorption ratio of a sheet P becomes high, and the sheet P is in such a state as to affect the transfer property of the toner image, the control unit 100 may determine that the sheet P is in the sheet moisture absorption state.

The first dehumidification mode is a control mode by the control unit 100, so that after performing a print-less sheet passing processing by one or a plurality of times, the image forming apparatus 1 performs an image forming operation. In other words, in the first dehumidification mode, the control unit 100 controls the operation of the image forming apparatus 1 so that the image forming apparatus 1 performs a print-less sheet passing processing by one or a plurality of times before performing an image forming operation. As described above, when the image forming apparatus 1 performs the print-less sheet passing processing by one or a plurality of times, the sheet P is passed to the fixing unit 70 and the reverse conveying path 51 by on or a plurality of times. The control unit 100 can set the number of times of print-less sheet passing processing which the image forming apparatus 1 performs, based on the class of a sheet, the presence or absence of dew condensation in sheet moisture absorption state, for example, the temperature information, or the humidity information.

The second dehumidification mode is a control mode by the control unit 100 so that, when it is determined by the control unit 100 that the sheet P is in the sheet moisture absorption state, the control unit 100 turns ON the damp heater 60, and then performs re-determination as to whether or not the sheet P is in the sheet moisture absorption state. In other words, in the second dehumidification mode, when determining that the sheet P is in the sheet moisture absorption state, the control unit 100 turns ON the damp heater 60, and performs re-determination as to whether or not the sheet P is in the sheet moisture absorption state. Specifically, the control unit 100 turns ON the damp heater 60, and after a prescribed time elapses when the moisture reducing effect caused by the heating of the damp heater 60 becomes apparent, the control unit 100 performs re-determination as to whether the sheet P is in the sheet moisture absorption state. If the ON state of the damp heater 60 continues, since wasteful power consumption is caused, when determining that the sheet P is not in the sheet moisture absorption state, in the re-determination of the sheet moisture absorption state, the control unit 100 turns OFF the damp heater 60.

The storage unit 105 stores an application program and an OS (Operating System). The application program includes a program with which the image forming apparatus 1 performs a moisture reducing processing function. The application program further includes an application program (Web browser) for a Web client and other application programs. The storage unit 105 is a hard disk drive and other magnetic storage device, an optical storage device, or a semiconductor storage device such as a flash memory and so on, and may be an optional combination of these.

The fixing unit 70, in the image forming operation, in order to fix the non-fixed toner image to a sheet P, heats the sheet P at a prescribed heating temperature (fixing temperature). In a print-less sheet passing processing to use the reverse conveying unit 51, the fixing unit 70 heats a sheet P at a heating temperature for moisture reducing processing which is different from the above-described fixing temperature. The heating temperature for moisture reducing processing may be lower than the fixing temperature, or may be higher.

Figure 3:
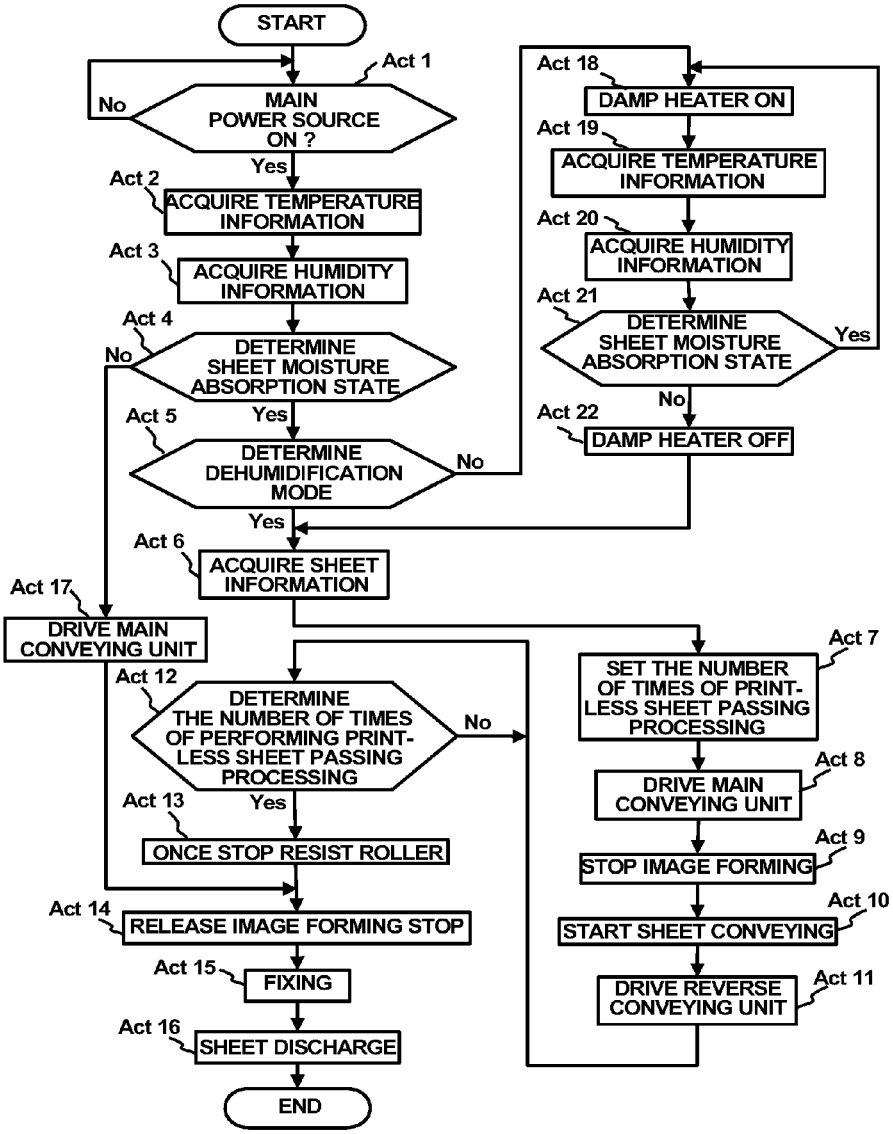
FIG. 3 is a flow chart for explaining a control operation of a moisture reducing processing of a sheet of the image forming apparatus according to the first embodiment.

Hereinafter, a control operation for moisture reducing processing of a sheet P will be described with reference to FIG. 3. FIG. 3 is a flow chart for explaining a control operation of a moisture reducing processing of a sheet P of the image forming apparatus 1.

As shown in FIG. 3, in an Act 1, the control unit 100 judges whether or not the main power source is turned ON. When the control unit 100 judges that the main power source is turned ON (Yes in the Act 1), the control operation by the control unit 100 proceeds to an Act 2. In the state where the main power source is turned OFF (No in the Act 1), the control unit 100 keeps the damp heater 60 to be turned OFF.

In the Act 2, the control unit 100 acquires temperature information from the image forming unit temperature sensor 81 and the temperature inside apparatus sensor 82. Furthermore, in an Act 3, the control unit 100 acquires humidity information from the humidity inside apparatus sensor 83. After the control unit 100 acquires the humidity information, the control operation by the control unit 100 proceeds to an Act 4.

In the Act 4, the control unit 100 determines whether or not a sheet P is in a sheet moisture absorption state, based on the temperature information and the humidity information respectively acquired in the above-described Act 2 and Act 3. Furthermore, the control unit 100 determines whether or not the operation unit 107 accepts a print instruction by a user. When the control unit 100 determines that the sheet P is in a sheet moisture absorption state, and when the control unit 100 determines that the operation unit 107 accepts a print instruction by a user (Yes in the Act 4), the control operation by the control unit 100 proceeds to an Act 5. Furthermore, when the control unit 100 determines that the sheet P is not in a sheet moisture absorption state, and when the control unit 100 determines that the operation unit 107 accepts a print instruction by a user (No in the Act 4), the control operation by the control unit 100 proceeds to an Act 17. On the other hand, when the control unit 100 determines that the operation unit 107 does not accept a print instruction by a user, the control unit 100 waits that the operation unit 107 accepts a print instruction by a user.

In the Act 5, the control unit 100 determines whether or not the mode for dehumidification is a first dehumidification mode or a second dehumidification mode. Specifically, the control unit 100 determines whether the operation unit 107 has accepted the selection of a first dehumidification mode by a user or has accepted the selection of a second dehumidification mode. When the control unit 100 determines that the operation unit 107 has accepted the selection of a first dehumidification mode by a user (Yes in the Act 5), the control operation of the control unit 100 proceeds to an Act 6. When the control unit 100 determines that the operation unit 107 has accepted the selection of a second dehumidification mode by a user (No in the Act 5), the control operation of the control unit 100 proceeds to an Act 18.

In the Act 6, the control unit 100 acquires sheet information from the sheet feeding cassette 34. After the control unit 100 acquires the sheet information, the control operation by the control unit 100 proceeds to an Act 7. The sheet information which the control unit 100 acquires in the above-described Act 6, is information indicating that a sheet P in the sheet feeding cassette 34 is a cardboard, or information indicating that a sheet P in the sheet feeding cassette 34 is a plain paper. When a sheet P in the sheet feeding cassette 34 is a cardboard, an amount of moisture absorbed in the sheet P is large.

In the Act 7, the control unit 100 sets the number (N) of times of print-less sheet passing processing. After the control unit 100 sets the number of times (N) of print-less sheet passing processing, the control operation by the control unit 100 proceeds to an Act 8. The number of times (N) of print-less sheet passing processing is the number of times of conveying operation, in which during the image forming operation stop state, the main conveying path 92 leads a sheet P taken out from the sheet feeding cassette 34 to the reverse conveying path 51, through the resist roller 73, the secondary transfer position 35, and the fixing unit 70, and the reverse conveying path 51 conveys the sheet P to the resist roller 73 again. The control unit 100 may fix the number of times (N) of print-less sheet passing processing to one time. Furthermore, the control unit 100 may set the number of times (N) of print-less sheet passing processing, based on the temperature information and the humidity information respectively acquired in the above-described Act 2 and Act 3, and the sheet information acquired in the above-described Act 6. Specifically, the control unit 100 judges whether or not a moisture absorption amount of the sheet P is large, based on the above-described temperature information, the above-described humidity information, and the above-described sheet information. When the control unit 100 judges that the moisture absorption amount of the sheet P is large, the control unit 100 judges that the print-less sheet passing processing of one time is not enough, in order to make the moisture absorption amount of the sheet P smaller than a prescribed moisture absorption amount. When judging that the print-less sheet passing processing of one time is not enough, the control unit 100 sets the number of times (N) of print-less sheet passing processing, based on the above-described information. The control unit 100 controls execution of the print-less sheet passing processings of N times, to pass the sheet P to the fixing unit 70 by N times, and evaporate the moisture absorbed in the sheet P.

In the Act 8, the control unit 100 drives the motor and so on of the main conveying unit 91, so as to make the print-less sheet passing processing to pass the sheet P taken out from the sheet feeding cassette 34 to be performed. Furthermore, when the position of the flapper is the above-described opening position, the control unit 100 rotates the flapper 80 so as to switch from the above-described opening position to the above-described closing position. After the control unit 100 drives the motor and so on, the control operation by the control unit 100 proceeds to an Act 9.

In the Act 9, the control unit 100 makes the image forming apparatus 1 to be in an image forming stop state, for the print-less sheet passing processing. The image forming apparatus 1 does not transfer a toner image to a sheet P, in the image forming stop state. In other words, the image forming apparatus 1 does not form a toner image on a sheet P, in the image forming stop state. The image forming apparatus 1 rotates the transfer belt 30, so as to make the sheet P pass through the secondary position 35 without forming a toner image, and convey the sheet P toward the fixing unit 70. Specifically, during the print-less sheet passing processing, the control unit 100 stops the operation of the laser exposure unit 11, for example, so that a toner image is not formed on the transfer belt 30. Furthermore, the control unit 100 stops the operation of the image forming units and the primary transfer rollers 41-44 of the image forming device 12. Furthermore, the control unit 100 rotates the transfer belt 30 and the secondary transfer roller 33 of the transfer unit, during the print-less sheet passing processing, so that the sheet P passing through the secondary transfer position 35 is conveyed toward the fixing unit 70. After the control unit 100 makes the image forming apparatus 1 to be in the image forming stop state, the control operation by the control unit 100 proceeds to an Act 10.

In the Act 10, the control unit 100 makes the conveying of the sheet P from the sheet feeding cassette 34 to be started for the print-less sheet passing processing. The main conveying path 92 conveys the sheet P to the sheet discharge roller 74 through the fixing unit 70. When the main conveying path 92 conveys the sheet P to the sheet discharge roller 74, the control unit 100 once stops the rotation of the sheet discharge roller 74, for the above-described switchback operation. After stopping the rotation of the sheet discharge roller 74, the control unit 100 rotates the flapper 80 so as to switch the position of the flapper 80 from the above-described closing position to the above-described opening position. After the control unit rotates the flapper 80, the control operation by the control unit 100 proceeds to an Act 11.

In the Act 11, the control unit 100 reversely rotates the sheet discharge roller 74, and further drives the motor of the reverse conveying unit 50. The sheet discharge roller 74 starts a switchback operation so as to send the sheet P which has been subjected to the moisture reducing processing by the fixing unit 70, to the reverse conveying unit 50. The reverse conveying path 51 of the reverse conveying unit 50 starts a conveying operation so as to convey the sheet P to the resist roller 73. When the reverse conveying path 51 conveys the sheet P to the resist roller 73, for example, the print-less sheet passing processing of one time is finished. When the reverse conveying path 52 starts conveying of the sheet P, the control operation by the control unit proceeds to an Act 12.

In the Act 12, the control unit determines whether or not the number of times of performing the print-less sheet passing processing reaches the set number of times N. For example, the control unit 100 detects passage of the sheet P by a sensor not shown arranged on the main conveying path 92 or the reverse conveying path 51, to count the number of times of performing the print-less sheet passing processing. When the sheet P is conveyed immediately before the resist roller 73, for example, the control unit 100 compares the above-described counting result with the set number of times, to determine whether or not the number of times of performing the print-less sheet passing processing reaches the set number of times N. When the control unit 100 determines that the number of times of performing the print-less sheet passing processing reaches the set number of times N (Yes in the Act 12), the control operation by the control unit 100 proceeds to an Act 13. When the control unit 100 determines that the number of times of performing the print-less sheet passing processing does not reach the set number of times N (No in the Act 12), the control unit 100 controls so as to perform the print-less sheet passing processing again. Specifically, the control unit 100 keeps the image forming apparatus 1 in the image forming stop state. The control unit 100 switches the position of the flapper 80 from the above-described opening position to the above-described closing position. The control unit 100 controls the rotations of the resist roller 73, the transfer belt 30, the secondary transfer roller 33, and the sheet discharge roller 74, so that the main conveying path 92 conveys the sheet P from the resist roller 73 to the sheet discharge roller 74 through the secondary transfer position 35 and the fixing unit 70. When the main conveying path 92 conveys the sheet P to the sheet discharge roller 74, the control unit 100 once stops the rotation of the sheet discharge roller 74, for the above-described switchback operation. After stopping the rotation of the sheet discharge roller 74, the control unit 100 switches the position of the flapper 80 from the above-described closing position to the above-described opening position. The control unit 100 reversely rotates the sheet discharge roller 74, and further drives the reverse conveying unit 50. The sheet discharge roller 74 sends the sheet which has been subjected to the moisture reducing processing again by the fixing unit 70, to the reverse conveying unit 50. The reverse conveying path 51 of the reverse conveying unit 50 conveys the sheet P to the resist roller 73 again. The control unit 100 controls the execution of the above-described print-less sheet passing processing, until the control unit 100 determines that the number of times of performing the print-less sheet passing processing reaches the set number of times N, in the above-described Act 12.

In the Act 13, the control unit 100 once stops the rotation of the resist roller 73, for example, to make the sheet P stand by at the position of the resist roller 73. When the control unit 100 makes the sheet P stand by at the position of the resist roller 73, the control operation by the control unit 100 proceeds to an Act 14.

In the Act 14, the control unit 100 controls the image forming device 12 and so on so as to release the above-described image forming stop state. In other words, the control unit 100 controls the operations of the image forming device 12 and so on, so that the image forming apparatus 1 starts the image forming operation. Specifically, the control unit 100 makes the laser exposure unit 11, the developing devices of the respective image forming units to supply toners to the photoconductor drums 21-24, and the primary transfer rollers 41-44 of the transfer unit operate, so that a toner image is formed on the transfer belt 30. The control unit 100 rotates the resist roller 73 in accordance with the above-described toner image forming timing. The main conveying path 92 conveys the sheet P after the moisture reducing processing to the secondary transfer position 35, by the rotation of the resist roller 73. The secondary transfer roller 33 transfers the toner image from the transfer belt 30 to the sheet P, at the secondary transfer position. When the secondary transfer roller 33 transfers the toner image to the sheet P, the control operation by the control unit proceeds to an Act 15.

In the Act 15, the control unit 100 controls the operation of the fixing unit 70 so that the fixing unit 70 fixes the toner image to the sheet. Furthermore, in an Act 16, the control unit 100 controls the operation of the sheet discharger roller 74 so that the sheet discharge roller 74 discharges the sheet P to the sheet discharge tray 75. When the sheet P is discharged to the sheet discharge tray 75, the image forming apparatus 1 finishes the print operation of an image.

On the other hand, when the control unit 100 determines that the sheet P is not in the sheet moisture absorption state, in the above-described Act 4, the control operation by the control unit 100 proceeds to the Act 17. In the Act 17, the control unit 100 drives the motor and so on of the main conveying unit 91. The main conveying path 92 of the main conveying unit 91 conveys the sheet P taken out from the sheet feeding cassette 34. When the control unit 100 drives the motor and so on of the main conveying unit 91, the control operation by the control unit 100 proceeds to the above-described Act 14. In the Act 14, the control unit 100 controls the operation of the image forming device 12 as described above, so that the image forming device 12 starts an image forming operation. Since the sheet P housed in the sheet feeding cassette 34 is in a low humidity state not requiring moisture reducing operation, the image forming apparatus 1 transfers the toner image on the sheet P, without performing the print-less sheet passing processing, and further fixes the toner image to the sheet P.

Furthermore, when the control unit 100 determines that the operation unit 107 has accepted the selection of the second dehumidification mode by a user, in the above-described Act 5, the control operation by the control unit 100 proceeds to the Act 18, as described above. In the Act 18, the control unit 100 turns ON the damp heater 60. Furthermore, in an Act 19, the control unit 100 acquires the temperature information similarly as in the above-described Act 2. In an Act 20, the control unit 100 acquires the humidity information similarly as in the above-described Act 3. After a prescribed time passes after the control unit 100 acquires the temperature information and the humidity information, the control operation by the control unit 100 proceeds to an Act 21. In the Act 21, the control unit 100 determines again whether or not the sheet P is in the sheet moisture absorption state. When the control unit 100 determines again that the sheet P is in the sheet moisture absorption state (Yes in the Act 21), the control operation by the control unit 100 returns to the above-described Act 18. In the above-described Act 18, the control unit 100 keeps the damp heater 60 in the ON state. When the control unit 100 determines again that the sheet P is not in the sheet moisture absorption state (No in the Act 21), the control operation by the control unit 100 proceeds to an Act 22. In the Act 22, the control unit 100 turns OFF the damp heater 60. When the control unit 100 turns OFF the damp heater 60, the control operation by the control unit 100 proceeds to the above-described Act 6. The control unit 100 performs the control operation from the above-described Act 6 to the above-described Act 16, to perform the image forming operation.

As described above, the image forming apparatus 1 turns OFF the damp heater 60 when the main power source is OFF. When the main power source is turned ON, the image forming apparatus 1 detects the temperature of the image forming device 12, the atmosphere temperature inside the image forming apparatus, and the atmosphere humidity inside the image forming apparatus, by the sensors 81-83. The image forming apparatus 1 judges that the sheet P in the sheet feeding cassette 34 is in a moisture absorbing state, when the temperature of the image forming device 12 is lower than the atmosphere temperature in the image forming apparatus, and the atmosphere humidity in the image forming apparatus is higher than a prescribed humidity. In the case that the sheet P is in the moisture absorbing state, when accepting the selection of the first dehumidification mode by a user, the image forming apparatus 1 conveys the sheet P taken out from the sheet feeding cassette 34, without transferring an image at the secondary transfer position 35, and passes the sheet P to the fixing unit 70. When passing through the fixing unit 70, the sheet P in the moisture absorbing state is heated by the fixing unit 70. Accordingly, the moisture in the sheet P evaporates, and the amount of moisture absorbed by the sheet comes down. The image forming apparatus 1 conveys the sheet P which has passed through the fixing unit 70 to the secondary transfer position again, using the reverse conveying unit 50. The number of times of performing the print-less sheet passing processing may be one time, or may be a plurality of times, as described above. The image forming apparatus 1 transfers the toner image to the sheet P after this print-less sheet passing processing at the secondary transfer position 35, and further passes the sheet P to the fixing unit 70, to fix the toner image to the sheet P. The image forming apparatus 1 discharges the sheet P to which the toner image has been fixed. Accordingly, the image forming apparatus 1 in the first dehumidification mode can form a good image on a printing sheet P, without generating an abnormal image such as transfer failure, even when a printing sheet P is in a moisture absorbing state.

Furthermore, when the sheet P is in the moisture absorbing state, upon accepting the selection of the second dehumidification mode by a user, the image forming apparatus 1 turns ON the damp heater 60. The image forming apparatus 1 turns ON the damp heater 60, and thereby the atmosphere temperature inside the image forming apparatus 1, and the temperature of the image forming device 12 of the image forming apparatus 1 rise, and the humidity inside the image forming apparatus 1 begins to drop, and the amount of moisture which the sheet P absorbs also drops. The image forming apparatus 1 keeps the damp heater ON till the humidity inside the apparatus becomes lower than a prescribed humidity. When judging that the humidity inside the apparatus drops to the prescribed humidity, the image forming apparatus 1 judges that the dew condensation temperature within the apparatus has become sufficiently high. When judging that the dew condensation temperature has become sufficiently high, the image forming apparatus 1 turns OFF the damp heater 60. When turning OFF the damp heater 60, the image forming apparatus 1 further performs the moisture reducing processing by the above-described print-less sheet passing processing. The image forming apparatus 1 performs printing an image on the sheet P after moisture reducing processing.

Specifically, when turning OFF the damp heater 60, the image forming apparatus 1 conveys the sheet P taken out from the sheet feeding cassette 34, and passes the sheet to the fixing unit 70, without transferring an image to the sheet P at the secondary transfer position 35. When passing through the fixing unit 70, the sheet P in the moisture absorbing state is heated by the fixing unit 70. Accordingly, the moisture of the sheet P evaporates, and the amount of moisture absorbed by the sheet comes down. The image forming apparatus 1 conveys the sheet P which has passed through the fixing unit 70 to the secondary transfer position 35 again, using the reverse conveying unit 50. The image forming apparatus 1 transfers the toner image to the sheet P after the print-less sheet passing processing, at the secondary transfer position 35. The image forming apparatus 1 further passes the sheet P to the fixing unit 70, to fix the toner image to the sheet P, and then discharges the sheet P to the sheet discharge tray 35.

As described above, the image forming apparatus according to the embodiment can form a good image on the sheet P without generating an abnormal image such as transfer failure, even if the sheet P absorbs moisture. Furthermore, the image forming apparatus according to the embodiment does not turn ON the damp heater 60 when the main power source is OFF. Since the image forming apparatus 1 does not turn ON the damp heater 60 when the main power source is OFF, it is possible to make the time for turning ON the damp heater 60 be the minimum required time.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image forming unit to form a toner image;

a transfer unit to transfer the toner image to a sheet;

a fixing unit to heat the sheet, to fix the toner image to the sheet;

a first conveying path to convey the sheet to the fixing unit through the transfer unit;

a second conveying path to convey the sheet which has passed through the fixing unit, to a position of the first conveying path which is more upstream than the transfer unit; and a control unit which controls execution of a print-less sheet passing processing in which, in a state where an image forming operation of the image forming unit is stopped, the first conveying path conveys the sheet to the fixing unit through the transfer unit, and the second conveying path conveys the sheet which has passed through the fixing unit to the first conveying paths again, and when judging that the first and the second conveying paths have performed the print-less sheet passing processing by a prescribed number of times, releases the image forming operation stop state, and controls so that the image forming unit performs the image forming operation, to the sheet to which the print-less sheet passing processing has been finished.

2. The image forming apparatus according to claim 1 further comprising a first temperature sensor to detect a temperature of an image forming device including the image forming unit and the transfer unit, a second temperature sensor to detect an atmosphere temperature inside the image forming apparatus, a humidity sensor to detect an atmosphere humidity inside the image forming apparatus, wherein: the control unit determines whether or not the print-less sheet passing processing is to be performed, based on detection information of the first temperature sensor, the second temperature sensor, the humidity sensor.

3. The image forming apparatus according to claim 2 wherein: the control unit controls the execution of the print-less sheet passing processing, when determining that the temperature detected by the first temperature sensor is lower than the temperature detected by the second temperature sensor, and the humidity detected by the humidity sensor is higher than a prescribed humidity.

4. The image forming apparatus according to claim 3 wherein: the control unit does not control the execution of the print-less sheet passing processing, but controls the execution of the image forming operation, when determining that the humidity detected by at least the humidity sensor is lower than a prescribed humidity.

5. The image forming apparatus according to claim 3 wherein: the control unit acquires information of the sheet, and sets a number of times of performing the print-less sheet passing processing, based on the information of the sheet, the temperatures detected by the first and second temperature sensors, and the humidity detected by the humidity sensor.

6. The image forming apparatus according to claim 5 further comprising a sheet feeding cassette to house the sheet and store the information of the sheet to be stored, wherein: the control unit acquires the information of the sheet from the sheet feeding cassette.

7. The image forming apparatus according to claim 5 wherein: the information of the sheet includes information indicating that the sheet is a cardboard, and information indicating that the sheet is a plain sheet.

8. The image forming apparatus according to claim 6 further comprising a damp heater to heat the sheet housed in the sheet feeding cassette, wherein: when a main power source of the apparatus is OFF, the control unit turns OFF the damp heater, and when the main power source is turned ON, and determining that the temperature detected by the first temperature sensor is lower than the temperature detected by the second temperature sensor, and the humidity detected by the humidity sensor is higher than a prescribed humidity, the control unit turns ON the damp heater.

9. The image forming apparatus according to claim 8 wherein: the control unit turns ON the damp heater, before controlling the execution of the print-less sheet passing processing.

10. The image forming apparatus according to claim 9 wherein: the control unit keeps the damp heater in an ON state, till the humidity detected by the humidity sensor becomes lower than a prescribed humidity, and when determining that the humidity detected by the humidity sensor has become lower than the prescribed humidity, the control unit turns OFF the damp heater, and controls the execution of the print-less sheet passing processing.

* * * * *